US005202134A

United States Patent [19]

Moellers et al.

[11] Patent Number: 5,202,134

[45] Date of Patent: Apr. 13, 1993

[54] OSCILLATING DEVICE FOR A CONTINUOUS CASTING MOLD

[75] Inventors: Gerd Moellers, Oberhausen; Dieter Kothe, Moers; Dietmar Lohse, Wesel, all of Fed. Rep. of Germany

[73] Assignee: Mannesmann Aktiengesellschaft, Dusseldorf, Fed. Rep. of Germany

[21] Appl. No.: 592,850

[22] Filed: Oct. 4, 1990

[30] Foreign Application Priority Data

Oct. 4, 1989 [DE] Fed. Rep. of Germany ..... 3933526

[51] Int. Cl.[5] ..... B22D 11/04

[52] U.S. Cl. ..... 425/425; 164/416; 425/432

[58] Field of Search ..... 164/415, 416; 425/425, 425/429, 432

[56] References Cited

U.S. PATENT DOCUMENTS

| | | | |
|---|---|---|---|
| 3,662,813 | 5/1972 | Stall | 164/416 |
| 3,703,923 | 11/1972 | Teplitz | 164/416 |
| 3,824,060 | 7/1974 | Helmrich et al. | 425/425 |
| 3,837,390 | 9/1974 | Bode, Jr. | 164/416 |
| 3,893,502 | 7/1975 | Slamar | 164/416 |
| 3,899,281 | 8/1975 | Jakobs | 425/432 |
| 3,900,065 | 8/1975 | Giunta et al. | 164/415 |
| 3,994,660 | 11/1976 | Ravet | 425/432 |
| 4,193,754 | 3/1980 | Sekiguchi | 425/432 |
| 4,238,177 | 12/1980 | Crile et al. | 425/432 |
| 4,532,975 | 8/1985 | Ives | 164/416 |
| 4,941,813 | 7/1990 | Grubb, Jr. et al. | 425/432 |

FOREIGN PATENT DOCUMENTS 1909710 9/1969 Fed. Rep. of Germany .

*Primary Examiner*—David A. Simmons
*Assistant Examiner*—William J. Matney, Jr.
*Attorney, Agent, or Firm*—Cohen, Pontani, Lieberman, Pavane

[57] ABSTRACT

An oscillating device for a continuous-casting mold is disclosed. The device includes a generally retangular base frame, two eccentric shafts arranged in parallel on the base frame and arranged to be driven in rotation. Each of the two eccentric shafts is connected to a respective pair of eccentrics that are arranged on corners of the base frame and by which oscillation can be imparted to the mold. The device includes a support plate having a centrally arranged opening in which the mold is fastened. A respective wear plate is positioned at each corner of the support plate, below the support plate. The wear plate rests on a respective eccentric outer ring that, in turn, is mounted for rotation on one of the pair of eccentrics that is driven in rotation. The device further includes spring bars arranged parallel to edges of the support plate and having connections at corner points to the base frame and, between the corner points, to the support plate.

4 Claims, 4 Drawing Sheets

OSCILLATING DEVICE FOR A CONTINUOUS CASTING MOLD

BACKGROUND AND SUMMARY OF THE INVENTION

The present invention relates to an oscillating device for continuous-casting molds.

A mold-oscillating device of the type in question is known from Federal Republic of Germany Unexamined Patent Application 19 09 710. The oscillating device consists of a square base frame in which cams are mounted on opposite end sides, the cams being driven by drive devices consisting of a shaft and drive motor. The mold is attached within a rectangular mold support frame on the bottom side of which bottom rollers are arranged in the corners, the rollers resting on the cams and transferring the oscillation to the mold. The mold support frame is held by guide devices which are in each case arranged in the center of the sides of the support frame, the guide devices having vertical rails and guide rollers that engage the rails. This has the disadvantage that too much play or latitude, is produced between guide rails and guide rollers by wear, which has the effect that, on the one hand, bottom rollers and cams no longer lie centrally on top of each other and, on the other hand, that precise guidance of the mold or the mold support frame is no longer assured. There is furthermore the disadvantage that a mold support frame must be used for mounting the mold so that a correspondingly large mass must be moved upon oscillation. Furthermore, this arrangement proves disadvantageous upon replacement of the mold.

It is therefore an object of the present invention to create an oscillating device for continuous-casting molds that has the smallest possible mass which must be moved and that assures exactly identical movement with the continuous casting path proposed.

The foregoing object is achieved in accordance with the invention in a device of the type described in the manner that the mold is fastened within a central opening in a support plate, that a wear plate is arranged on each corner of the support plate, the wear plate resting, in this connection, on an eccentric outer ring which is rotatably mounted on the ecentric which is driven in rotation, and that spring bars, arranged parallel to the edges of the support plate, can be connected at the corner points to the base frame and between the corner points to the support plate. In one advantageous embodiment of the invention, the connection between spring bar and support plate is effected by a metal plate which is detachably fastened, on the one hand, by screws to the spring bar and, on the other hand, by a wedge-connection to the support plate. The connection between the spring bars and the corners of the base frame comprises, in each case, a support pedestal attached on the base frame and a cube-shaped attachment element which is arranged at the corresponding end of the spring bar and can be displaced parallel to the longitudinal axis of the spring for the adjustment of the mold and can be connected in operating condition in force-locked manner to the support pedestal and the spring bar. The parallel eccentric shafts are in this case preferably capable of being driven in opposite direction with respect to each other.

The advantages obtained by the invention consist, in particular, in the fact that, on the one hand, due to the saving of weight, the replacement of the mold is facilitated and the drive force is reduced, and, on the other hand, the wear of the oscillating device itself is reduced. Lateral outward movement of the mold during oscillation is prevented by the lateral spring bars which are connected in rapidly detachable manner to the connecting plates by screws and the connecting plates to the support plate by wedge-connections.

BRIEF DESCRIPTION OF THE DRAWING

The foregoing and further objects and advantages of the invention will become apparent from the following detailed description of the invention when read in connection with the accompanying drawing, in which.

DETAILED DESCRIPTION OF THE PRESENTLY PREFERRED EMBODIMENTS

Figure 1:
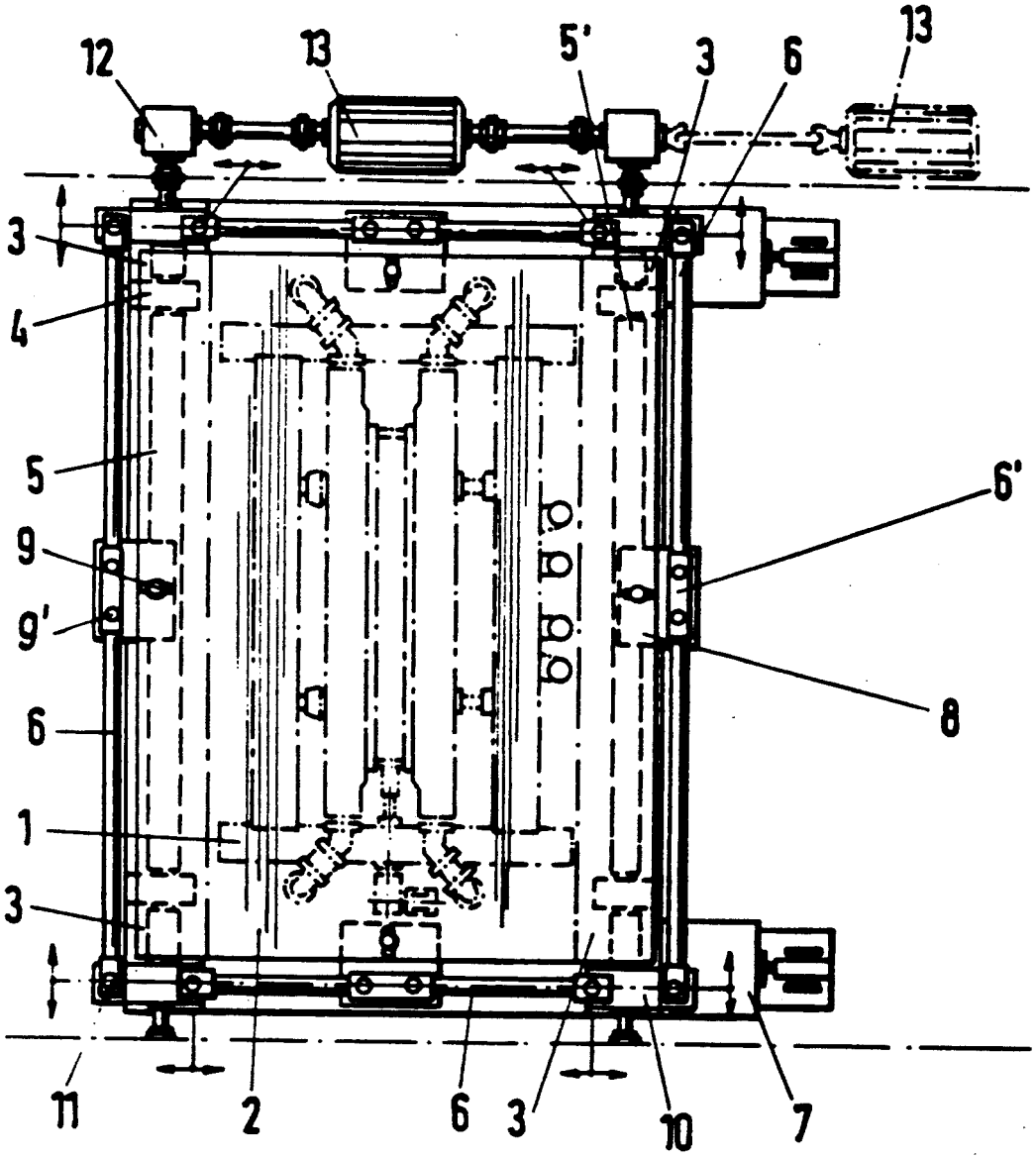
FIG. 1 is a top view of the entire mold-oscillating device of the invention.

FIG. 1 is an overall view of various elements arranged in a mold-oscillating device according to the invention. The mold 1 is fastened centrally in the opening in a support plate 2 and rests at the corners of the support plate via wear plates 3 attached there on eccentrics 4. Spring bars 6, which are arranged laterally around the support plate 2, are connected at the corners of a base frame 7, by support pedestals 10, to the base frame 7 itself. The metal plates 8, which serve as connecting elements between the spring bars 6 and the support plate 2, are in each case arranged centrally on the sides of the support plate 2. The connecting plates 8 are fastened, on the one side, by screws 9' to the spring bars 6 and, on the other side, by wedges 9 to the support plate 2. These spring bars 6, which are attached in punctiform manner to the support plate 2, prevent lateral outward movement of the mold 1 during oscillation; that is, during the oscillation, the spring bars 6 are subjected to bending stress corresponding to the amplitude of the oscillation. The eccentrics 4 arranged below the wear plates 3 are driven by two parallel eccentric shafts 5, 5'. The eccentric shafts 5, 5' themselves are connected to a drive motor 13 via corner gearings 12. For a drive motor there is used either a motor with output drives on both sides and which is arranged between the corner gearings, or a drive motor which is arranged outside the corner gearings.

Figure 2:
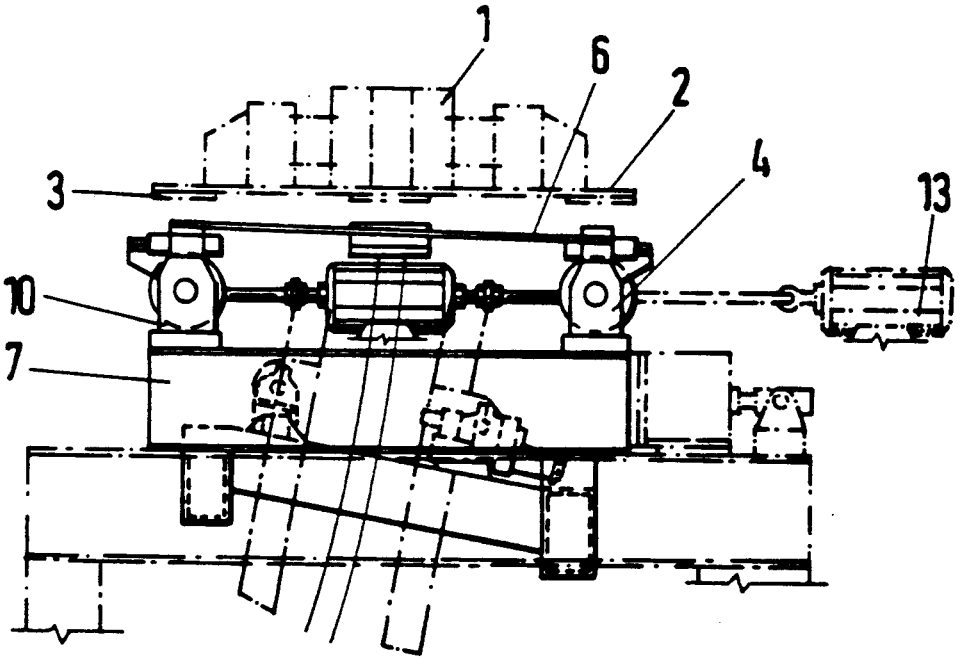
FIG. 2 is a front view of the mold-oscillating device of FIG. 1.
Figure 3A:
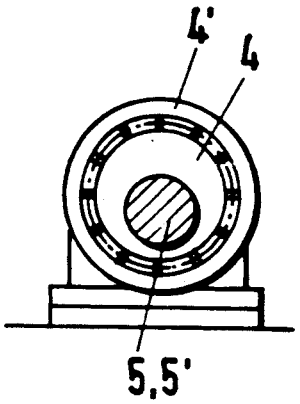
FIG. 3A is a cross-section through an eccentric of the mold-oscillating device of FIG. 1.
Figure 3B:
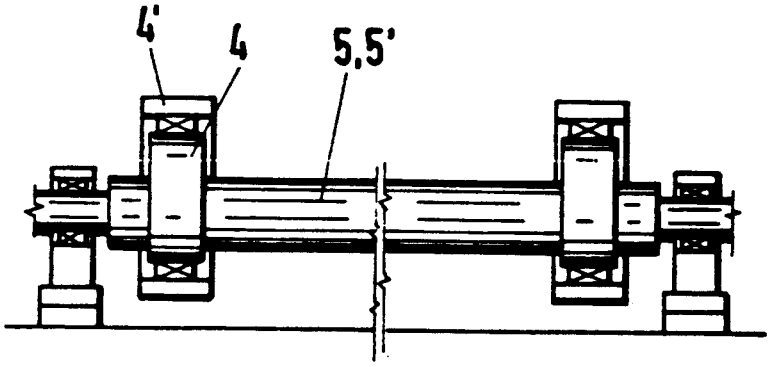
FIG. 3B is a side view of the eccentric of FIG. 3A and of a cooperating eccentric shaft.
Figure 3C:
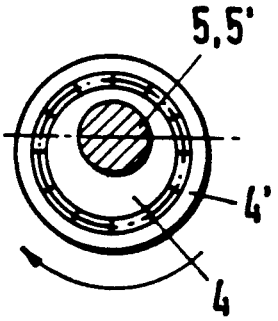
FIGS. 3C and 3D are cross-sections through the eccentric of FIG. 3A at various stages of operation.
Figure 3D:
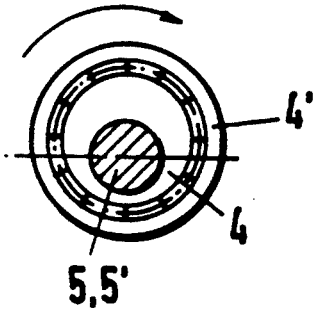

FIG. 2 shows the arrangement of the support pedestals 10 in connection with the spring bars 6 and the precise position of the wear plates 3. The wear plates 3 are arranged on the bottom side of the support plate 2, i.e. between an eccentric outer ring 4' (FIG. 3) mounted on the eccentric 4 and support plate 2.

On the eccentric 4 in FIGS. 3A–3D there is mounted an eccentric outer ring 4', which converts the rotary motion of the eccentric or the eccentric shaft 5, 5' (FIG.

1) into a stroke motion and transmits an oscillation to the support plate 2 or the mold 1 (FIG. 1) due to the fact that the wear plate 3 rests on the eccentric outer ring 4'.

Figure 4:
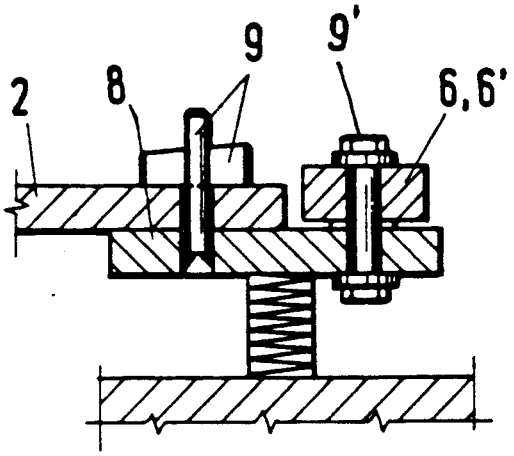
FIG. 4 is a cross-section through a spring bar and its connection to a support plate of FIG. 5 taken at arrows IV—IV in FIG. 5.

FIG. 4 shows a section through the spring bar 6 and its attachment to the support plate 2. The spring bar 6 has in its middle a thickening 6' through which bore holes 6" (FIG. 5) pass. These bore holes 6" serve to produce a detachable screw attachment 9' with the connecting plate 8 The connecting plate 8 is connected in rapidly detachable manner to the support plate 2 by a wedge 9.

Figure 5:
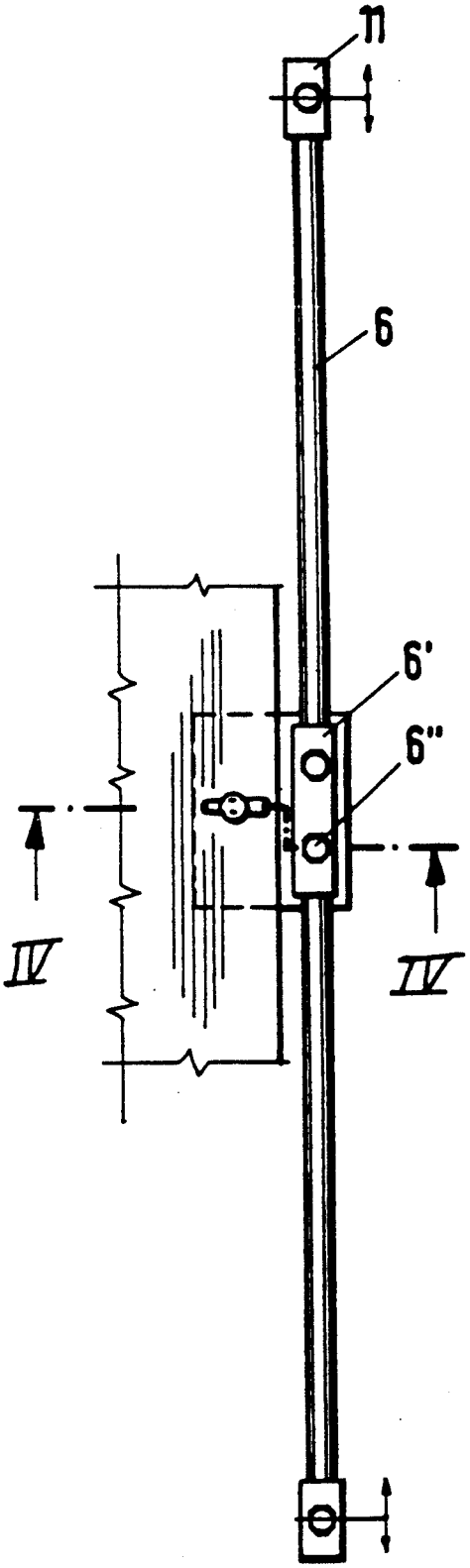
FIG. 5 is a top view of the spring bar and the connection of FIG. 4.

FIG. 5 is a top view of a spring bar 6. It shows, in particular, the thickening 6' arranged in the middle and the attachment to the support plate 2. Attachment elements 11 are arranged at the ends of the spring bar 6, bore holes passing through said attachment elements and making it possible to attach the spring bar 6 to the base frame 7 via the support pedestals 10 (FIG. 1). These attachment elements 11 are so developed that for adjustment purposes they can be slightly displaced in the direction of the longitudinal axis of the spring bar and can, in operating condition, be connected in force-locked manner to the supporting pedestals 10. This makes restressing of the spring bars 6 possible.

The oscillating device is so developed that all types of molds, i.e. straight molds as well as arcuate molds, can be used. Furthermore, the development of the eccentric 4 with the eccentric outer ring 4' is such that at this place customary eccentric adjustment devices can be installed as desired in order to select different amplitudes of oscillation. The compact but relatively simple construction furthermore makes possible rapid replacement of a casting guide segment which is attached to the base frame.

It should be understood that the preferred embodiments and examples described are for illustrative purposes only and are not to be construed as limiting the scope of the present invention which is properly delineated only in the appended claims.

What is claimed is:

1. An oscillating device for a continuous-casting mold, comprising:

a generally rectangular base frame;

two eccentric shafts arranged in parallel on the base frame and arranged to be driven in rotation;

each of said two eccentric shafts being connected to a respective pair of eccentrics that are arranged on corners of the base frame and by which oscillation can be imparted to the mold;

a support plate having a centrally arranged opening in which the mold is fastened;

a respective wear plate positioned at each corner of the support plate below the support plate, each wear plate resting on a respective eccentric outer ring that, in turn, is mounted for rotation on one of the pair of eccentrics that is driven in rotation; and spring bars arranged parallel to edges of the support plate and having connections at corner points to the base frame and, between the corner points, to the support plate, wherein each of the connections between the spring bars and the base frame comprises a support pedestal attached to the base frame and a fastening element which, in operating condition, is connected in force-locked manner to the support pedestal and the spring bar, such that said spring bars substantially transfer the weight of the mold and support plate to the base frame.

2. An oscillating device for a continuous-casting mold according to claim 1, wherein the connections between the spring bars and the support plate each comprises a metal plate that is connected on one side in a detachable manner by one or more screws to the spring bar and, on another side, by a wedge-connection to the support plate.

3. An oscillating device for a continuous-casting mold according to claim 1, wherein the fastening element is tube-shaped and is arranged on the corresponding end of the spring bar such that it can be displaced parallel to a longitudinal axis of the spring bar in order to adjust the mold.

4. An oscillating device for a continuous-casting mold according to claim 1 wherein the parallel eccentric shafts are arranged to be driven in opposite direction to each other.

* * * * *